United States Patent [19]

Cowlin et al.

[11] 4,348,277

[45] Sep. 7, 1982

[54] ARTICLE SORTING APPARATUS AND METHOD

[75] Inventors: Robert M. Cowlin, Leiston; Nigel C. Helsby, Maldon, both of England

[73] Assignee: Lockwood Graders (UK) Limited, Essex, England

[21] Appl. No.: 141,927

[22] Filed: Apr. 21, 1980

[30] Foreign Application Priority Data

Nov. 6, 1979 [GB] United Kingdom ..... 7938336

[51] Int. Cl.[3] ..... B07C 9/00

[52] U.S. Cl. ..... 209/705; 209/939; 209/942; 358/106; 414/134

[58] Field of Search ..... 209/614, 702, 703, 704, 209/705, 939, 942; 414/134, 135, 136; 358/106

[56] References Cited

U.S. PATENT DOCUMENTS

| | | | |
|---|---|---|---|
| 3,581,887 | 6/1971 | Radutsky et al. | 209/939 |
| 4,164,291 | 8/1979 | Carlow | 209/942 |
| 4,184,598 | 1/1980 | Cowlin et al. | 209/705 |

FOREIGN PATENT DOCUMENTS

| | | |
|---|---|---|
| 1387407 | 3/1975 | United Kingdom . |
| 1401289 | 7/1975 | United Kingdom . |
| 1534590 | 12/1978 | United Kingdom . |

OTHER PUBLICATIONS

"Lockwood Graders Ltd.", Teleselect, 12–78.

*Primary Examiner*—Joseph J. Rolla

*Attorney, Agent, or Firm*—Cushman, Darby & Cushman

[57] ABSTRACT

In apparatus for sorting potatoes a roller table conveyor conveys potatoes beneath a television camera which produces on a television monitor screen a picture of an inspection area of the roller table. An operator watching the monitor screen selects potatoes to be rejected by pointing a light pen at the monitor screen. The light pen feeds to a microcomputer a signal indicative of the light pen position on the television monitor screen, which corresponds to a transient position of the potato in the inspection area. Sensors deriving signals from sprocket-wheels coupled to the conveyor feed to the microcomputer a signal dependent upon the conveyor speed, and the microcomputer actuates selectively a bank of deflector fingers to deflect reject potatoes. The choice of deflector fingers actuated is determined by one orthogonal co-ordinate of the light pen, and the timing of actuation of the deflector fingers is determined by the other orthogonal co-ordinate of the light pen and the speed of the conveyor.

13 Claims, 6 Drawing Figures

ARTICLE SORTING APPARATUS AND METHOD

The present invention relates to apparatus for and a method of sorting articles and has particular, but not exclusive, application to the sorting of root vegetables, for example, potatoes.

It is now common practice in potato harvesting to employ automatic means to separate potatoes from soil and stones and to grade the crop by size. However, quality selection (i.e. the removal of sub-standard potatoes from acceptable potatoes) is often not automated and still relies upon operators picking out sub-standard potatoes as the crop passes along an inspection table. This quality selection procedure is ineffecient in terms of labour deployment and is usually the speed-determining step in potato handling.

It has previously been proposed to improve operator efficiency by providing automatic removal means responsive to a position-indicating signal from a manually operable indicator. In this system, the indicator comprises an oscillating coil which is actuated when the indicator is pressed on a potato to be rejected and the position of the potato is indicated by a signal induced by an orthogonal array of coils disposed beneath the inspection table. Such a system has a number of inherent disadvantages, including the need to make physical contact with sub-standard potatoes and to align the potatoes carefully on the table relative to the array of coils because of lack of good resolution.

In U.S. Pat. No. 4,184,598 there is described an alternative system of generating a position-indicating signal for use in potato sorting which does not require physical contact with the reject potato and which can readily be designed to eliminate, or at least reduce, the degree of potato alignment required on the inspection table and to operate at a higher resolution than the known system described above.

In accordance with our said previous patent there is provided article sorting apparatus comprising conveying means for simultaneously conveying two or more articles to be sorted through an inspection area; a reference frame in fixed spatial relationship to said area; a rigid selector member carried by said frame and movable with respect thereto; emitter means for emitting a continual stream of energy or matter at a fixed angle to the selector member and movable with said member to selectively impinge on locations within the inspection area to indicate a transient position of an article in said area; signal means responsive to the position of the selector member relative to the reference frame for generating a position-dependent signal; switch means for selectively actuating said signal means to generate a signal indicative of said transient position; and deflector means responsive to said signal for selectively deflecting said indicated article.

Conveniently the said selector member is an elongated arm emitting a beam of light from one end thereof and pivotally mounted at the other end thereof on the reference frame by a swivel joint. The signal means is conveniently located at the upper, swivel joint end of the arm and generates electrical position-dependent signals defined by the angle of swivel of the arm. Conveniently the switch means comprises a manually operated trigger on a pistol grip holder which is used also to control the direction of the light beam onto a selected potato.

In operation the potatoes or other articles are conveyed past an operator who observes the potatoes directly and manoeuvres the pistol grip until the light beam is shining on a selected, reject potato. The trigger is then pulled and the appropriate position-indicating signal is supplied to a downstream deflector means which, after an appropriate delay, deflects the unwanted potato.

Although the apparatus described in our previous patent has considerable advantages over known systems, in terms of speed and accuracy of operation, operator comfort, and separation of electrical and mechanical components from the region of dirt and wear by the articles being sorted, there remain certain difficulties for the operator in having to scan visually a relatively wide inspection area, and in having a substantial physical movement in the movement of the pistol grip and associated selector arm. It is an object inter alia of the present invention to provide a sorting apparatus in which the difficulties are reduced or removed. In addition to the sorting of potatoes, it will be appreciated that the system of the present invention has application to sorting other articles, especially but not exclusively other root vegetables and bulbs.

According to the present invention there is provided an article sorting apparatus comprising conveying means for conveying articles to be sorted through an inspection area, image means for presenting at a monitor display area an image of the inspection area, selection means for selecting an article displayed at the monitor display area and for generating signals indicative of selected articles, deflector means for selectively deflecting articles, and control means for actuating the deflector means in dependence upon signals generated by the selection means to effect selective deflection of articles in response to article selection by an operator observing the monitor display area.

The invention finds particular application where the monitor display area is arranged to show at the display area simultaneously two or more articles to be sorted and the selection means is arranged for selecting an article from two or more articles displayed simultaneously at the display area.

In accordance with a preferred aspect of the invention, the selection means may comprise indicator means for indicating a location on the monitor display area corresponding to a location of a selected article in the inspection area and for generating a signal indicative of a transient position of the selected article in the inspection area. Conveniently the indicator means may be arranged for generating a location signal indicative of a location at the monitor display area indicated by the indicator means, and the indicator means may include switch means for actuating the generation of the location signal at a chosen time to generate the said signal indicative of the transient position of the selected article in the selection area.

The indicator means may include manual input means, such as a push-button panel or keyboard, spaced from the monitor display area for indicating a location at the monitor display area, but it is preferred that the indicator means includes an indicator member for indicating a location at the monitor display area by moving the indicator member to or towards the said location. It is also preferred that the said switch means comprises a switch responsive to pressure or touch of the indicator member on a screen on which the said image of the inspection area is displayed. Conveniently the indicator member may comprise a hand held indicator or stylus, and it is particularly preferred that the image means includes a television display screen and the selection means includes a light pen which constitutes the indicator member of the preferred aspect set out above. Such a light pen is known in itself and comprises a light sensing element at the end of a hand held stylus, the light sensing element detecting the passage of the scanning spot of the television screen past the view of the light detector. By comparing the instant at which the light pen detects the scanning spot, with the line and field scan timing, there can be derived the x y co-ordinates of the light pen position relative to the scanning raster. Thus by the term "light pen" is meant a device movable relative to a television display screen to indicate a location on the screen, and arranged to give an output signal derived by detection of the scanning spot on the television screen and indicative of the location indicated by the device on the screen.

Although as has been said the use of a light pen is preferable in connection with the invention, it is to be appreciated that there will be found a wide variety of image means and selection means which can be used. A number of examples of different forms will now be given, and various combinations of these forms may be produced.

As an alternative to a television display screen, the image means may be constituted by other devices such as an epidiascope. In place of the hand held indicator member which has been described, an arrow or other indicating symbol may be produced electronically upon a television display screen, and may be moved to indicate an article by, for example, a joy-stick control of the kind used in television games.

The means for generating location signals indicative of a location indicated on the monitor display area may for example be constituted by field means for providing a field of detectable signals across the screen and detection means associated with an indicator member for detecting signals in the region of the screen which define the location of the indicator member on the screen. The position of the indicator member may be sensed in a number of ways, for example by a transparent resistive panel positioned over the front of a television screen, or by a magnetic, electrostatic, or other x-y co-ordinate panel associated with the screen. The position indicating signals maybe derived either from a detector on the indicator member, or from the grid of wires or other field means which may be activated by the presence of the indicator member. Such methods of deriving x-y co-ordinate signals from the tip of an indicator member are well known in the computer display art and will be readily available to one skilled in the art.

The switch means for selectively actuating the generation of location indicating signals may be a manually operable switch, especially a trigger mounted on an indicator member, but preferably is an automatic switch responsive to pressure or touch of the indicator member on a display screen. For example the switch means may comprise a microphone or accelerometer mounted on the tip of the indicator member and sensitive to the indicator member being tapped or touched on a screen.

Returning now to a more general consideration of preferred aspects of the present invention, it is particularly preferred that the control means is arranged to actuate the deflector means in dependence upon first and second co-ordinate signals representative of first and second orthogonal co-ordinates of locations at the monitor display area, the orthogonal co-ordinates being arranged with the first co-ordinate in a direction corresponding to a direction across the path of travel of the conveyor means at the inspection area and with the second co-ordinate in a direction corresponding to a direction aligned along the path of travel of the conveyor means at the inspection area. It is further preferred that the deflector means comprises an array of deflector devices arranged across the path of the conveyor means downstream of the inspection area, and drive means for driving selected deflector devices, the selection of deflector devices actuated being controlled in dependence upon the said first co-ordinate signals and the timing of operation of the deflector devices being controlled in dependence upon the said second co-ordinate signals.

In accordance with another preferred feature of the present invention, the deflector means are situated downstream of the inspection area relative to the movement of the conveyor means, and there are provided conveyor sensor means for producing and feeding to the control means signals dependent upon the speed of the conveyor means, the control means being arranged to control actuation of the deflector means at times related to the transient positions of selected articles at the time of selection and to the speed of movement of said articles from the inspection area to the deflector means. Conveniently such conveyor sensor means includes at least one optical sensor arranged to detect rotation of a sprocket wheel driving the conveyor means in motion.

There may be provided a plurality of selection means for operation by one or more operators, each selection means allowing selection of articles being conveyed through the common inspection area. Such arrangements allow, for example, two operators to each have an indicator member operable on a common television monitor screen viewed by the operators, so that the chance of a reject article being missed is reduced by the two operators viewing the common screen. Alternatively or in addition an operator may have two indicator members one for each hand and may conveniently operate over a wider area of monitor display area.

It may also be arranged that there is provided a plurality of monitor display areas showing the same image of the same inspection area and a plurality of selection means for operation by different operators, each selection means allowing selection of articles being conveyed through the common inspection area. Thus for example there may be a number of television display screens each showing the same picture, and operators may each operate with their own display screen and their own selection means, although the decisions made may be made operable on common deflector means. This again reduces the chance of incorrect selection being made.

There have been described above a number of optional and preferred features of the present invention, and there will now be set out a particularly preferred combination of a number of these features. In accordance with this preferred aspect of the present invention there is provided article sorting apparatus comprising conveying means for conveying simultaneously two or more articles to be sorted through an inspection area, image means for presenting at a monitor display area an image of the display area including two or more articles displayed simultaneously at the display area, indicator means including an indicator member movable with respect to the monitor display area for indicating a location at the display area corresponding to a location of a selected article selected from two or more articles in the said inspection area, the indicator means being arranged for generating a location signal representative of a location at the monitor display area indicated by the indicator member, and the indicator means including switch means for actuating the generation of the location signal at a chosen time to generate a signal which is indicative of a transient position of a selected article in the said inspection area, deflector means for selectively deflecting articles, and control means for actuating the deflector means in dependence upon signals generated by the selection means to effect selective deflection of articles in response to article selection by an operator observing the monitor display area.

The deflector means may comprise fingers for deflecting articles falling from the conveyor means, the fingers being actuable between two or more positions so as to direct the falling articles onto different conveyor belts or other receptacles. In the case of potatoes or other root vegetables or bulbs, the said fingers can be of a kind well known in themselves for separating produce from soils and stones using, for example, x-ray beams to distinguish the difference. Usually the deflector means will be located downstream of the inspection area, and in such cases the signals controlling actuation of the deflector means will be processed in the control means in order to compensate for the time delay for the articles to pass from the indicated transient positions in the inspection area to the deflector means.

However it is to be appreciated that the deflector means may constitute means for deflecting selected, or unselected articles at substantially the same time that the articles are selected. In such case of course no time delay needs to be introduced which is related to the speed of conveying. One method of achieving such deflection is for example to provide beneath the conveyor means a bank of ejector rods which can be triggered to project upwardly through apertures in the conveyor means to strike, for example, unwanted articles and to propel such articles clear of the conveyor means. Such arrangements have previously been used in connection with sorting of potatoes from stones, where unwanted stones have been ejected in this manner. It is to be understood that the term deflector means includes not only means for deflecting articles through differing angles during travel of the articles, but also includes means for removing articles entirely from a conveying path, and indeed includes any means for effecting sorting of objects in response to the signals generated by the selection means.

The conveying means preferably comprises a roller table over which the articles are conveyed in the inspection area. A roller table is a conveyor formed of a plurality of rotatable elongate members, known as rollers, connected together by, for example, side chains to form an endless array in which the rollers are spaced apart with their axes parallel and transversed to the direction of translational movement. Articles are conveyed in transversely extending rows supported by adjacent pairs of rollers. The rollers are rotated over at least part of the endless conveyor path in order to rotate the articles conveyed thereon to evenly distribute the articles on the conveyor and/or to sequentially present the whole surface of the articles for inspection. However it is to be appreciated that the conveyor means may alternatively consist of a conveyor belt which may include ribs or other dividing portions for maintaining articles in predetermined positions, or in some cases may be a smooth conveyor belt.

There is also provided in accordance with the present invention a method of sorting articles comprising the steps of conveying articles to be sorted through an inspection area, displaying at a monitor display area an image of the inspection area, selecting articles displayed at the monitor display area, and generating by reference to the image of the articles at the display area signals indicative of the articles selected, and selectively deflecting articles in dependence upon article indicating signals generated by reference to the said image.

As has been mentioned in connection with the apparatus according to the present invention, the invention finds particular application where the method includes the step of showing at the monitor display area simultaneously two or more articles to be sorted and selecting an article from the two or more articles displayed simultaneously at the display area.

The method may include selecting an article displayed at the monitor display area by indicating a location at the display area corresponding to a location of the selected article in the inspection area, and generating a signal indicative of the transient position of the selected article in the inspection area.

In a preferred form of the method, there may be included the steps of displaying the said image on a television display screen constituting the said monitor display area, indicating the said location at the monitor display area by a light pen, and generating the said signal indicative of the selected article by signals derived from the light pen.

In accordance with a further preferred form of the method according to the present invention, the signals indicative of selected articles are generated by generating first and second co-ordinate signals representative of first and second orthogonal co-ordinates of a location on the monitor display area, the orthogonal co-ordinates being arranged with the first co-ordinate in a direction corresponding to a direction across the path of conveying of the articles at the inspection area and with the second co-ordinate in a direction corresponding to a direction aligned along the path of conveying of the articles at the inspection area. It is yet further preferred that the step of selectively deflecting articles comprises arranging an array of deflector devices across the path of the conveying of the articles downstream of the inspection area, and actuating selected deflector devices, the selection of deflector devices actuated being controlled in dependence upon the said first co-ordinate signals and the timing of operation of the deflector devices being controlled in dependence upon the said second co-ordinate signals.

In accordance with another preferred form of the method according to the present invention the method includes the step of generating conveyor sensing signals dependent upon the speed of conveying of the articles, the step of selectively deflecting articles comprising arranging the deflector means downstream of the inspection area, and the step of actuating the deflector means comprising actuating the deflector means at times related to the transient positions of selected articles at the times of selection thereof and related to the speed of movement of said articles from the inspection area to the deflector means.

Embodiments of the invention will now be described by way of example with reference to the accompanying drawings in which.

Figure 1:
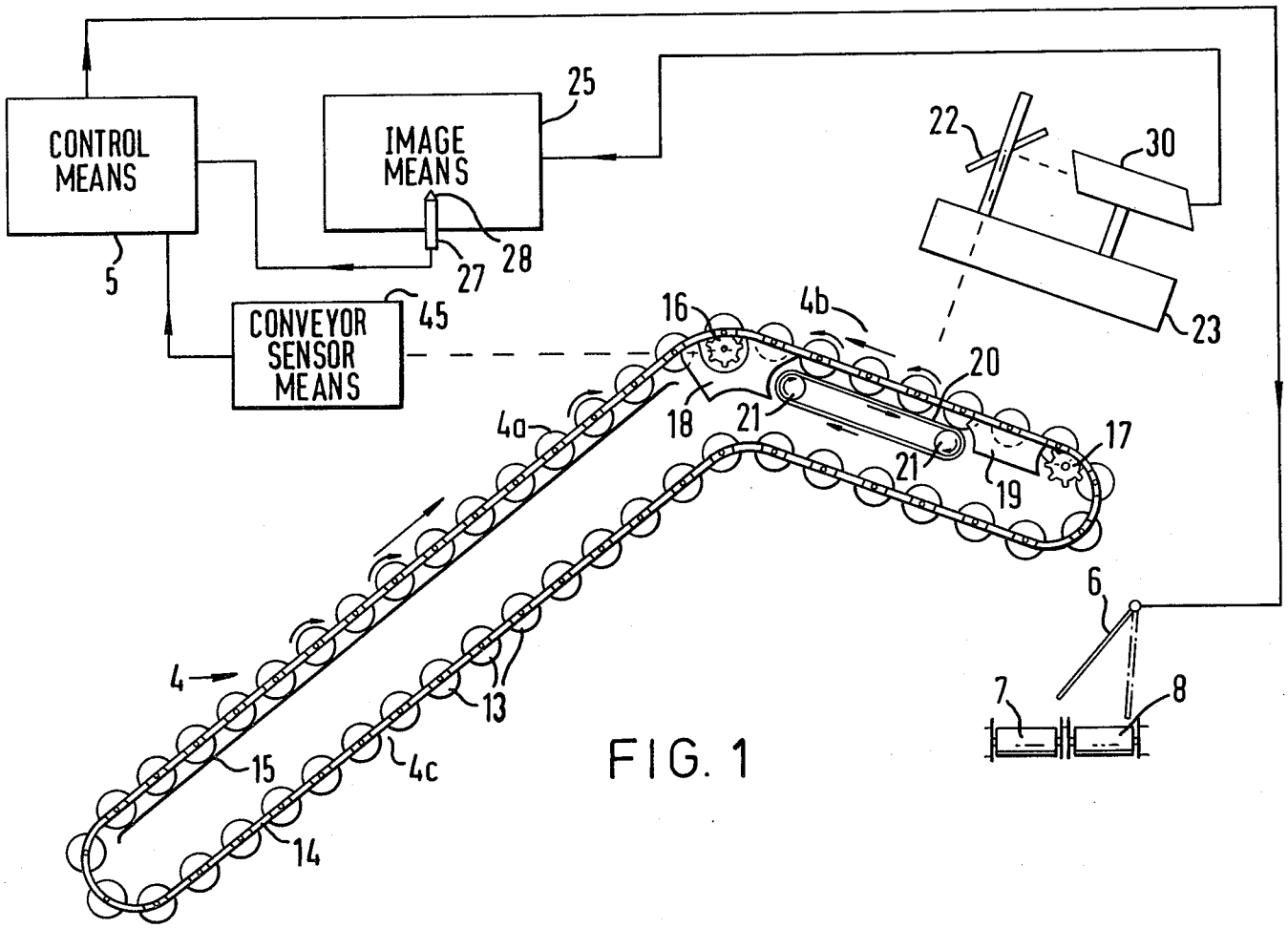
FIG. 1 is a schematic side view of a potato sorter in accordance with a preferred embodiment of the present invention.
Figure 2:
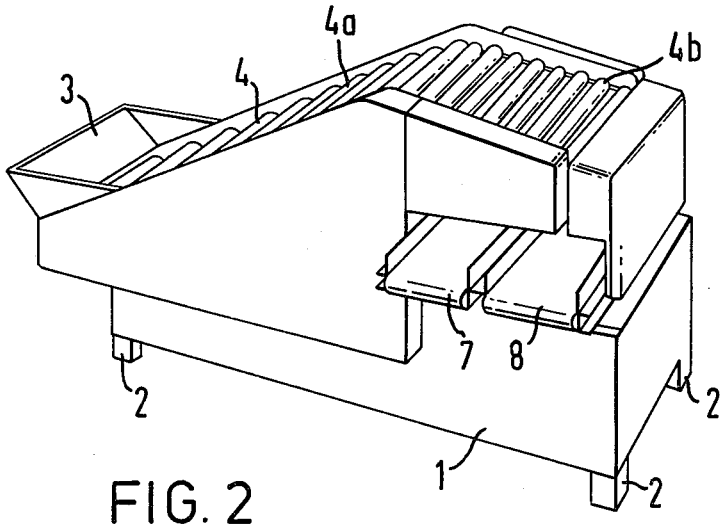
FIG. 2 is a perspective view of the roller table of the potato sorter shown diagrammatically in FIG. 1.
Figure 3:
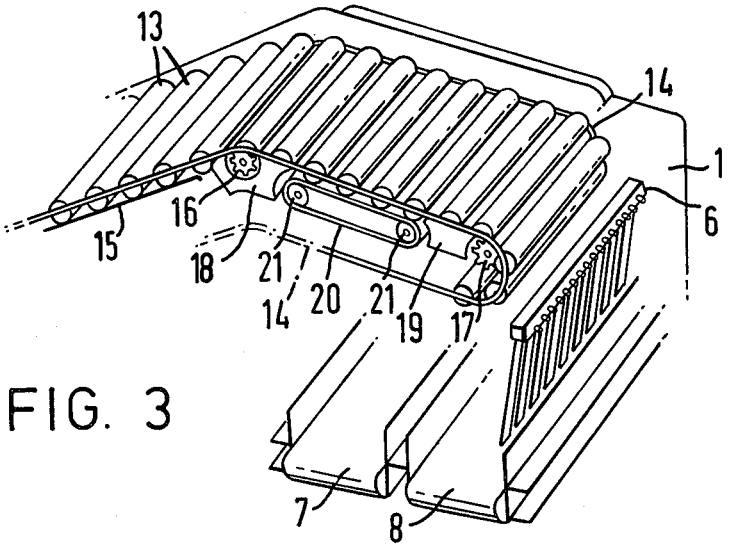
FIG. 3 is a view on a larger scale corresponding to FIG. 2 and showing part of the potato sorter with some casing and frame members omitted.

Referring firstly to FIGS. 1, 2 and 3 of the drawings, a potato sorting machine comprises a body 1 (FIG. 2) formed of a framework supported on four legs 2 and clad with casing sheets. A hopper 3 is provided at the rear, input end of the machine to receive the potatoes from, for example, a pre-cleaner in which clods and stones have been separated from the potatoes. A roller table conveyor 4 conveys the potatoes from the hopper along an upwardly inclined path 4*a* to a slightly downwardly inclined inspection area 4*b* at the forward end of the machine. Mounted above the inspection area 4*b* is a video camera 30 mounted on a fixed framework 23. The camera receives a visual image of the inspection area 4*b* by way of a mirror 22. The output of the video camera 30 is fed to a video monitor screen 25 to be observed by the operator of the sorting machine. The video camera and video monitor may conveniently be constituted by a real-time closed circuit television system. As will be explained hereinafter, the operator indicates the position of a selected, "reject", potato on the screen 25 by means of a hand-held probe 27. Signals from the probe 27 are fed to a control means 5. Information as to the rate of movement of the conveyor 4 is detected by conveyor sensor means 45 and is fed to the control assembly 5. A signal from the control means 5 actuates appropriate fingers of a finger bank 6 to deflect reject potatoes onto a reject conveyor 7. In the absence of a signal from the control means 5, the fingers direct the potatoes onto a produce conveyor 8.

The roller table 4 and conveyors 7 and 8 are driven in conventional manner by chains and sprockets (not shown) from a central motor (also not shown). The electrical supply for the motor and for other electrical components is provided from a mains 240 volt AC supply. The finger bank 6 is pneumatically operated in known manner by compressed air from an electrical compressor (not shown) provided in the body 1.

The roller table 4 comprises a plurality of right circular wooden rollers 13 rotatably mounted in an endless array with their axes parallel between two transversely spaced endless side chains 14 in known manner. The path of the roller table extends from the hopper 3 along the upwardly inclined path 4*a* to the inspection area 4*b* and then returns along a lower return path 4*c* to the hopper. In the path 4*a*, the rollers 13 rest upon a pair of transversely spaced support runners 15 whereby the translational movement of the rollers 13 along the path 4*a* imparted by the driven chains 14 cause the rollers 13 to rotate in the clockwise direction as viewed in the Figures. A pair of transversely spaced sprockets 16 are provided at the top of path (flight) 4*a* to engage respective side chains 14 and a corresponding pair of sprockets 17 are provided to engage and support the respective side chains 14 at the forward end of the inspection area 4*b*. Respective wooden blocks 18, 19 are provided adjacent to the sprockets 16, 17 to support the respective side chains 14 and thereby to allow the rollers 13 to lose rotational momentum.

An endless belt 20 supported by spaced drive rollers 21 is located within the roller table between the blocks 18 and 19 so that the rollers 30 in the inspection area rest upon the upper flight of the belt 20. The belt is driven by the rollers 21 so that the upper flight moves in the same translational direction as the rollers 13 in contact therewith. Suitably, the belt 20 is moved at about 1.5 times the translational speed of the rollers and thereby cause the rollers to rotate in an anti-clockwise direction as viewed in the Figures.

It will be appreciated that the translational speed of the upper surface of the rollers 13 when in contact with the support runners 15 is greater than the translational speed of the chains 14 because of the rotation imparted by contact with the runners 15. This condition is advantageous for distributing potatoes from the hopper 3 into transversely extending rows where they rest between adjacent pairs of rollers. When the rollers 13 are in contact with the belt 20, the upper surface of the rollers 13 move in the opposite translational sense to the chains 14. The difference in speed between the said upper surface and the chains is such that the upper surface moves at half the translational speed of the chains. The slower speed is advantageous because the potatoes rotate at a relatively slower speed enabling defects in the potatoes to be more easily observed. Moreover, since the potatoes rotate in the opposite sense to the rollers, the upper surfaces of the potatoes will be moving in the same sense as the chains and thereby are less likely to cause feelings of nausea in operatives inspecting the potatoes for defects.

The manner in which the probe 27 generates a signal giving information as to the probe position on the screen 25 may take different forms as will be described hereinafter. The probe 27 is actuated or enabled by a switch or trigger 28 at the tip of the probe so that a position-dependent signal is available only when the trigger is operated by the operator. The trigger is conveniently a microphone or an accelerometer responsive to a light touch of the probe 27 on the screen 25.

The signal from the probe 27 is processed (for example in the control means 5) to control assembly 5 to provide in effect the orthogonal x and y co-ordinates of the point of the inspection area corresponding to the location indicated on the monitor screen 25. The transverse position of a potatoe on a full roller table will not change substantially during passage from the point of indication to the forward discharge end of the table. However, there will be a time delay before it reaches the forward end and therefore the signals derived from the probe are processed in the control means in dependence upon to the translational speed of the roller table to compensate for this time delay. Appropriate circuitry for providing this time delay will be readily apparent to those familiar with electrical control logic.

The processed signal from the control means 5 is fed to the finger bank 6 provided at the forward end of the machine. The finger bank 6 is known in itself for use in, for example, separating clods and stones from potatoes by X-ray pre-cleaners and therefore will not be described in detail. Each finger of the bank is movable independently of the remaining fingers in response to a respective processed signal from the control means 5. If desired, each finger can be arranged to operate with an adjacent finger depending upon the transverse position of the reject potato on the inspection table. In their normal position, the fingers are inclined downwardly to direct potatoes onto the produce conveyor 8. When actuated to reject a potato a finger is caused or allowed to pivot by a small amount in a clockwise direction as viewed in the Figures to deflect reject potatoes onto the reject conveyor 7.

In operation, an operator observes the video monitor screen 25 and moves the probe 27 to point the probe at a reject potato. When the probe 27 indicates a reject potato, the operator actuates trigger 28 thereby causing a position-dependent signal to be made available by the probe. The signal is processed and fed to the finger bank to move the appropriate finger or fingers to deflect the reject potato onto the reject conveyor 7 when the potato falls from the end of the roller table.

Figure 4:
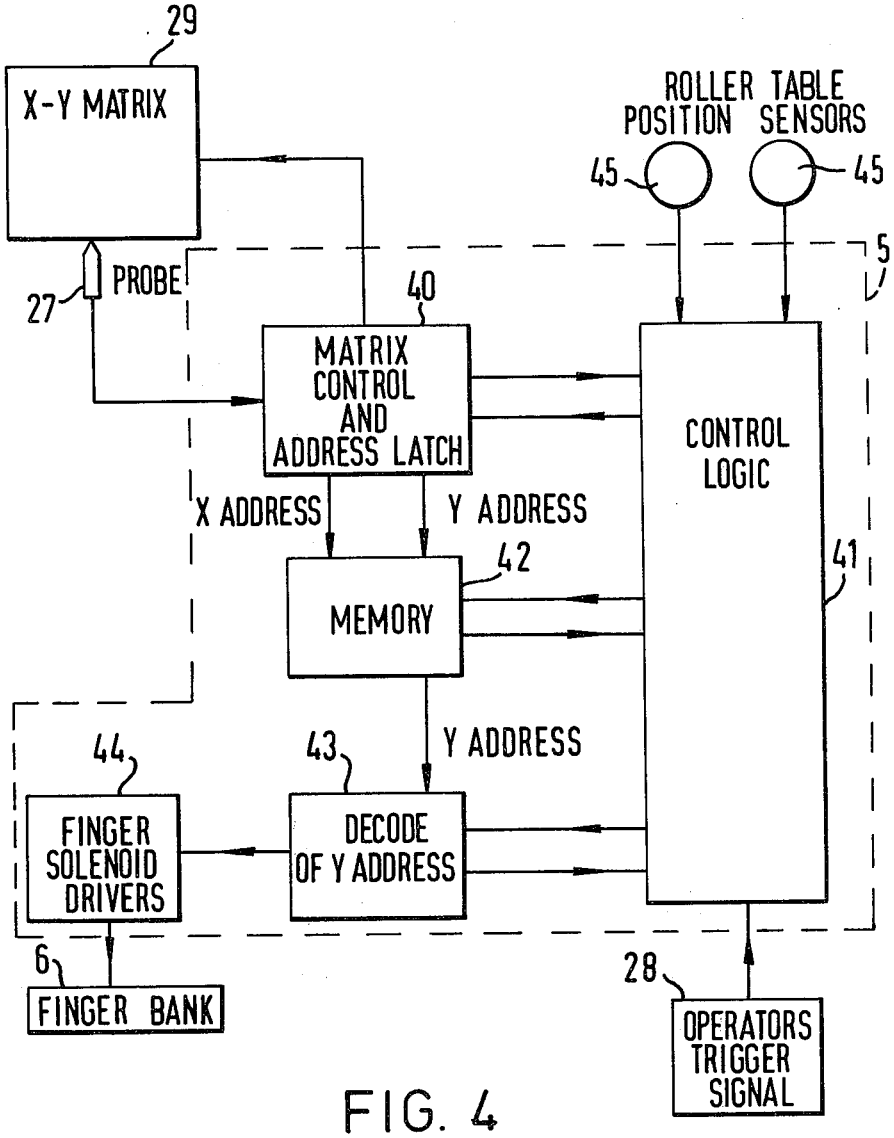
FIG. 4 is a block circuit diagram of one arrangement of the control means forming part of the potato sorter shown in FIG. 1.

Referring now to FIG. 4 there will be described in more detail one form of the control means 5. In this arrangement there is provided across the screen of the monitor 29 an x-y matrix of a field means (for example orthogonal current carrying wires) producing a field from which the probe 27 picks up x and y co-ordinate signals which represent its location on the screen of the monitor 29. The x-y matrix 29 is energised by a matrix control and address latch 40, and the output signal from the probe 27 is returned to the circuit 40. A main control logic 41 controls the circuit 40 and also receives an output therefrom. The circuit 40 provides output signals representing x addresses and y addresses of the probe and feeds these signals to a memory 42 which again is controlled by the control logic 41. From the memory 42 there is fed an output signal comprising a y address only, but this address is fed at the correct delayed time determined by the x-address of the probe 27. The y-address is decoded by a decoder 43 (again controlled by the control logic 41) and a resultant output signal is used to energise an appropriate finger solenoid driver of a bank of such drivers 44. The drivers 44 are connected to move the fingers 6.

The control logic 41 also receives signals from roller table position sensors 45, and from the trigger 28 shown diagrammatically in FIG. 4 as an element separate from the probe 27. The signals from the sensors 45 tie the roller speed with the x address of the probe 27 to produce the correct time output from the memory 42, and the trigger 28 controls the time at which the x-y signal fed to the latch 40 is utilised.

Preferably it is arranged in accordance with the invention that indicators show the position of the probe, or where the last signal was plotted and at the same time a sound tells that the probe signal has been accepted into the logic. The operator can also see which fingers are operating and can also check that the probe signal is in line with the right finger by looking at a logic path on the screen. The speed of the selection table can be made automatically to adjust to the flow of potatoes and the percentage of rejects in the sample. This ensures maximum throughput coupled with efficient selecting.

The embodiment described is particularly convenient for sorting peeled potatoes, in which case the good parts look very white and the bad parts black. The camera and monitor may therefore be a black and white television camera and display monitor, although a colour system may be used if it is desired to reject, say, green potatoes.

Thus the device can be designed for peeled potato quality selection—the potatoes being white and the defects black. Potatoes, when coming from a steam peeler are hot and extremely slippery, making them very difficult to handle. The majority of defects are just below the skin and can be removed by an abrasive type peeler. So potatoes with black marks shown up on the television screen and are diverted to the abrasive peeler by the operator touching the image with the probe.

However, the coming availability of cheaper colour television cameras opens up the possibility of seeing all manner of defects, some of which like greening the camera may recognise itself, and save the operator the job of spotting them.

The sorter may also be used in other applications where objects do not have to be a regular shape, do not have to be presented in single file, and do not have to be presented at a set speed.

There will be described a more preferred form of indicator member which may replace the probe described with reference to FIG. 4. As has been mentioned, as set of co-ordinates for each point on the image displayed may be obtained by a number of means and a preferred method employs a light sensitive probe which is pointed at the chosen object seen as an image on the cathode ray display tube. Use may then be made of the fact that the light on the face of this tube is in fact composed of a raster scan, i.e. the phosphor on the inside of the tube face is caused to glow by a scanning electron beam which traces a pattern of lines horizontally which are spaced out by virtue of a similar but slower vertical scan. The moment at which both vertical scanning and horizontal scanning commences is known and the moment at which the scanning beam reaches the light sensitive probe may also be determined by the electrical signal obtained from it. Thus its position may be found in terms of vertical and horizontal co-ordinates, the vertical position being determined by the time taken for the vertical scan to reach the probe measured from the start of scan, and the horizontal position by the time taken for the horizontal or line scan to reach the probe. The probe in fact "sees" a short element on each of a group of lines on the picture and these are counted electronically so that for example the fifth line is used as this is known to give consistently valid co-ordinates. If a standard television system is used for example 625 line 50 fields per second the co-ordinates are updated every 20 ms; the vertical position from the reference start of scan is some fraction of 20 ms and the horizontal position is some fraction of 64 $\mu$s measured from the start of line scan. The vertical position may also be measured by counting the number of lines which occur from the start of vertical scan before the probe signal is received. The picture displayed on the cathode ray tube is obtained from the camera whose light sensitive tube is subject to a similar scan operating in synchronism as is well known in television systems.

When the operator sees a reject or chosen article he places the probe over that point on the display and presses a switch. This operation may be speeded up by automatically operating a switch when the probe touches the screen. As has been mentioned, one way of eliminating a mechanical switch when this method is used is to incorporate an acceleration sensor in the probe which detects the rapid decceleration when the probe touches the screen and automatically sends a signal to operate an electronic switch.

Each time that this switch operates, the current set of co-ordinates for the probe (which will have been obtained just before the probe touched the screen) are stored on a memory and the procedure previously described is used to re-route or reject the chosen items.

The preferred form of the probe may be further described as follows. The probe has an optical sensing head which generates a signal from the light on the face of the television screen. This light is generated by the scanning electron beam of the cathode ray tube which is repeatedly scanning across the raster of the tube (line scan) and down the face of the tube (field scan). Hence the moment at which the light pulse is received by the probe relative to the start of each of these scans contains information from which co-ordinates x and y of its position may be deduced. The start of the line scan is signalled by "line drive" and that of the field scan by "field drive". The co-ordinates are found by counting pulses from two oscillators which are reset respectively by "line drive" and "field drive".

This method is used as it readily allows some adjustment of the effective electronic grid so generated so that the positional information relates directly to the image from the television camera which is displayed on the face of the cathode ray tube.

The effective electronic "grid" mentioned above may be displayed on the screen overlayed on the image of the roller table from the camera. By indicating the line of the fingers on the roller table the camera image may be aligned so that the line of the fingers seen by the camera fits the vertical stripes of the grid pattern. When the camera position is approximately correct, final adjustment may be made by altering the frequency of the vertical stripes and the horizontal position of the stripes.

A similar procedure is followed for the horizontal stripes which are aligned in frequency to coincide with the roller pitch as seen by the camera and in vertical position to ensure rejection of the produce from the desired roller.

The camera should be aligned to view the correct portion of the roller table so that the maximum deviation of the probe from the centre of a line between any two rollers may be obtained in either direction along the roller table before the fingers come up for the neighbouring roller. The fingers should come up before the produce falls from the desired roller and stay up after the rejection by an approximately equal amount: this timing is controlled entirely by the conveyor sensor means 45, which may derive signals from a 4 tooth sprocket drive wheel and a 16 sprocket drive wheel on the conveyor means. The four tooth wheel is adjusted to perfect this timing. The 16 tooth wheel provides a fine adjustment equivalent to $\pm\frac{1}{8}$th of a roller pitch in setting the maximum permitted deviation of the probe from the centre line between two rollers for correct rejection of produce between those rollers.

Figure 5:
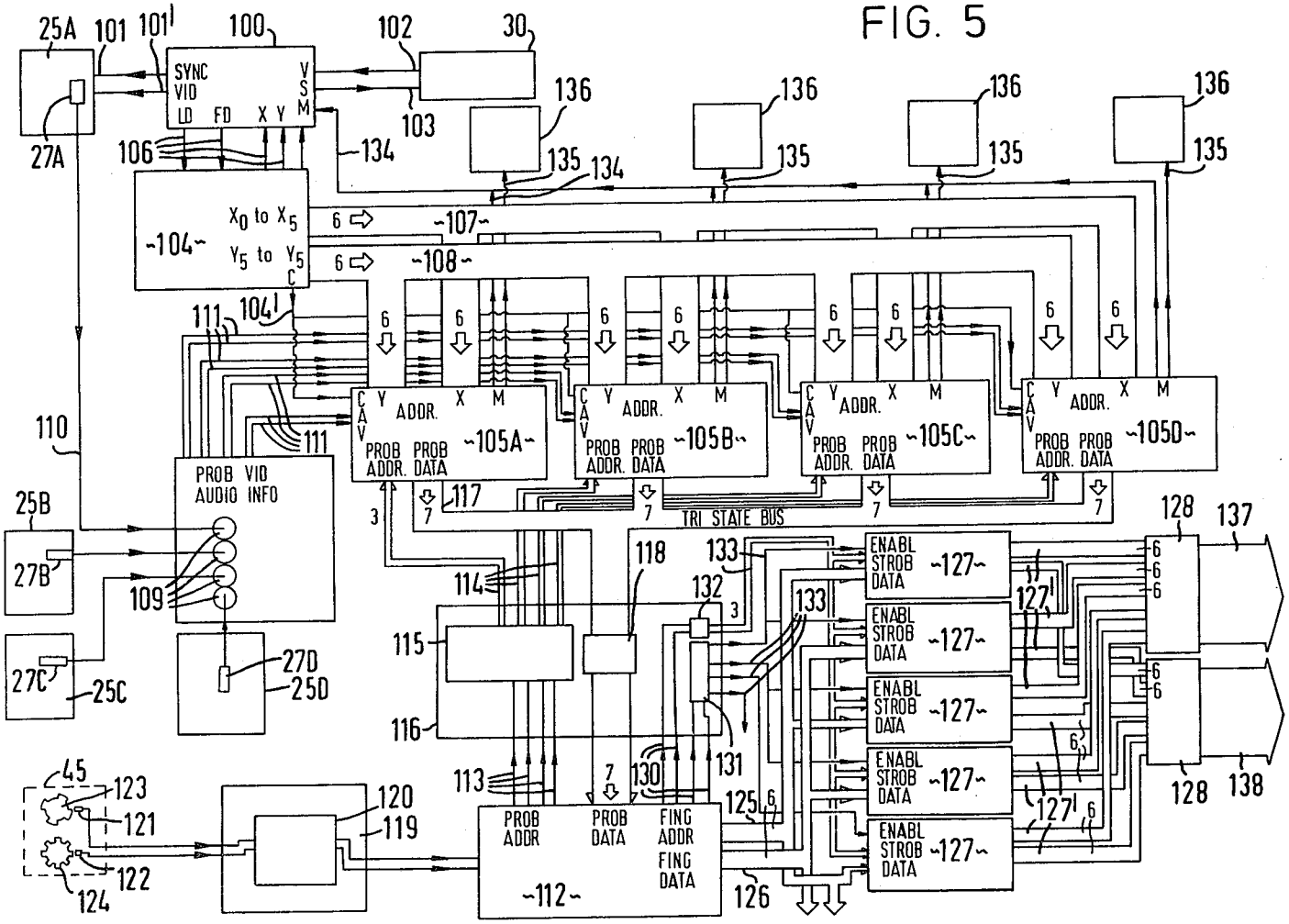
FIG. 5 is a block circuit diagram of an alternative, preferred form of the control means forming part of the potato sorter shown in FIG. 1.

There will now be described with reference to FIG. 5 an embodiment of the invention which follows generally the schematic diagram shown in FIG. 1, but shows in more detail how the control assembly 5 may be put into effect using a micro computer. The embodiment of FIG. 5 also shows how the inspection area 4*b* of FIG. 1 can be displayed on a number of television monitor screens 25 with a number of associated probes 27. The main items shown in FIG. 1 are indicated in FIG. 5 by the same reference numerals. Where a number of elements are repeated due to the presence of more than one display screen 25, the elements are indicated by the appropriate reference numeral followed by a reference numeral indicating which of the display screens is associated with that element. The arrangement and operation will be described in detail with reference to only one television monitor 25, the remaining monitors being connected and operating in a similar way.

The main components of the embodiments shown in FIG. 5 comprise the television camera 30 shown previously in the arrangement of FIG. 1, four television monitor screens indicated at 25*a*, 25*b*, 25*c* and 25*d*, each having associated therewith a corresponding probe indicated at 27*a* to 27*d*. Information as to the movement of the roller table conveyor 13 in FIG. 1 is provided from the roller table position sensing unit 45 shown in FIG. 1. The remaining elements shown in FIG. 5 constitute the control assembly 5 of FIG. 1. The actual deflecting mechanisms 6 of FIG. 1 are omitted from FIG. 5.

Considering in particular the television monitor 25*a*, the screen scanning is controlled by a synchronizing pulse generator 100 by way of line 101. The video output from the camera 30 is fed to the sync generator 100 along line 102, and the controlling synchronizing pulses are fed to the camera 30 along line 103.

A master address generator 104 comprises a printed circuit board which generates x and y addresses for controlling feeding of information to four probe registers 105*a* to 105*d*. The master address generator 104 is linked to the sync generator 100 by five lines 106 to receive line drive and field drive signals and to feed x y display information to the sync generator. The x y information provides on the monitor guide lines for aligning the camera over the inspection area. The master address generator 104 is linked to each of the probe registers 105*a* to 105*d* by six line buses 107 and 108 to feed x y addresses to the registers and by a clock pulse line 104'.

The video information is fed from the television camera 30 along the line 102 by way of the sync generator 100 and the line 101' to the monitor 25*a*, where the selected object is indicated by the probe 27*a*. The probe 27*a* is connected to a bank of probe amplifiers 109 by a line 110 along which is passed a video output signal giving information as to the probe position, and an audio signal consisting of an on/off signal from the switching means (28 in FIG. 1) actuated when the probe 27*a* is tapped onto the screen. In the example of FIG. 5, the probe 27*a* is a light pen and the video signal on the line 110 is essentially a timing signal which is related with the synchronizing information from the sync generator 100 to derive the x y co-ordinates of the probe 27*a*. Outputs from the bank of probe amplifiers 109 are fed along lines 111 to respective probe registers 105*a* to 105*d*, and the x y positional information is latched into the probe registers 105*a* to 105*d* under the control of the x y addresses fed from the generator 104 along the buses 107 and 108.

The control assembly of FIG. 5 includes a micro computer 112 which interrogates the probe registers 105*a* to 105*d* along probe address lines 113 and 114 by way of a control decode circuit 115 housed in a probe buffer assembly 116. Information read from the probe registers 105*a* to 105*d* is fed to the micro computer along a tri state bus 117 by way of a CMOS-TTL converter 118 situated in the probe buffer assembly 116.

The micro computer 112 also receives information as to the position and movement of the roller table conveyor 13 by way of a machine interface assembly 119 including opto-couplers 120. The table movement information is derived from the roller table position sensing unit 45 which in this case comprises two sensors 121 and 122 which operate respectively from two toothed wheels 123 and 124 rotated on a common shaft driving the roller table conveyor. The toothed wheel 123 has four teeth and the toothed wheel 124 has sixteen teeth. The wheel 123 indicates the position of each roller along the inspection area, and the toothed wheel 124 gives a fine determination of where produce is in the inspection area. The sensors 121 and 122 generate pulses in response to movement of the teeth of the wheels 123 and 124.

Figure 6:
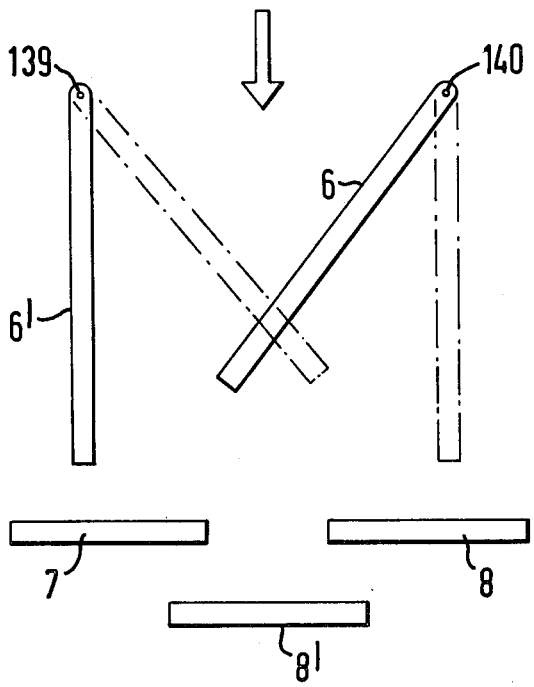
FIG. 6 is a diagrammatic representation of deflector means for use with the control means shown in FIG. 5.

The output of information concerning selected and non-selected particles is fed from the micro computer 112 along to data buses 125 and 126 to a series of finger latches 127 which determine whether required fingers are in a deflect or non-deflect position. The outputs 127' of the latches are then grouped in two groups in finger buffer circuits 128 and 129 before being fed to two banks of fingers which are shown in FIG. 6 and will be described hereinafter. The outputs from the finger buffers 128 and 129 are fed to actuate the solenoids of the required fingers so as to achieve three way selection between three output conduits or receptacles. The control of routing of information from the micro computer 112 to the latches 127 is controlled by decoding signals fed from the micro computer 112 along lines 130 to a decode finger address unit 131 and a strobe generator 132 in the probe buffer assembly 116. Outputs from these units are fed along lines 133 to the latches 127 to control cycling of the output from the micro computer 112 along the buses 125 and 126 to the required latch addresses.

Two further outputs from each of the probe registers 105*a* to 105*d* are made along a bus 134 to the sync generator 100 and along lines 135 to a set of four audio markers 136. The purpose of these outputs from the probe registers is to alert the operator to a completed input of information by actuating the switch on the probe. The indication is made by a visual video signal along the bus 134 which produces a flash on the screen, and by an audio signal which produces a blip at the audio markers 136.

It will be appreciated that by virtue of the way in which all the monitors 25*a* to 25*d* are synchronized in their scanning when displaying a picture from the same camera 30, it is possible by extending the number of address latches 127 to add further probes each of which may have a different operator. Any probe may then be used on any monitor screen to indicate the selected or rejected item, or all probes may be used on the same screen.

Referring now to FIG. 6 there will be described the arrangement of two banks of fingers 6 and 6' which are fed at two output groups of 26 lines each indicated at 137 and 138 in FIG. 5. The fingers 6 and 6' are pivotable about pivots 139 and 140 respectively and are movable between dotted line positions and full line positions in the figure by pneumatic drive units not shown. Three output conveyor belts 7, 8 and 8' are positioned with the belts 7 and 8 on either side of the assembly with a gap between the two belts, and with the third belt 8' positioned centrally below the said gap. Of the various permutations of the two fingers 6 and 6' the combination with both fingers in the central position is a non-effective position and is not available under the direction of the micro computer 112. With both the fingers 6 and 6' in the vertical positions, the articles to be sorted are allowed to fall freely between the conveyor belts 7 and 8 onto the central conveyor belt 8'. With the finger 6 in the full line position and the finger 6' in the full line position, the articles to be sorted are directed by the finger 6' onto the conveyor belt 7. With the fingers 6' in the dotted position and the fingers 6 in the dotted line position, the articles to be sorted are directed onto the conveyor belt 8. Thus by operating permitted combinations of the two finger banks, a three state selection can be made from amongst the articles being sorted.

Referring now again to FIG. 5 there will be described the general operation of the control assembly shown, although it is to be appreciated that the operation follows generally the manner previously described with reference to FIGS. 1 and 4. The co-ordinates of the probe positions are obtained as previously described from counters synchronized to the T.V. camera 30 in the address generator 104 and stored in the individual registers 105*a* to 105*d* for each of the probes 27*a* to 27*b*. When any probe indicates a reject article by, for example, tapping the screen of its monitor, the co-ordinates of the probe are latched into the associated probe register in addition to the setting of a flip-flop in the probe register unit to act as a flag indicating that the selection has been made. It is convenient in the embodiment shown to use the micro computer 112 which follows a program of instructions stored in a memory to examine regularly the probe flags and, when one is found "set", to transfer the contents of that probe register to the micro computer memory, and then to reset the flag. This computer 112 also receives pulses from the roller table sensors 121 and 122 and is able in addition to send information to the further sets of latches 127 which drive the selection mechanism consisting of the two banks of fingers fed from the outputs 137 and 138.

The stored probe information is updated each time a pulse is received from the roller table sensors 121 and 122, so that as the articles progress those which have been selected are tracked by the computer 112 which may then generate signals to operate the selection fingers at the appropriate time. The micro computer 112 has three main tasks, namely the repeated monitoring of the probe flags, responding to the roller table sensors, and driving the finger control or selection circuits.

In the foregoing description reference has been made to a number of preferred forms of features of the invention for example a roller table form of conveying means and an electronic control means for actuating a deflector means after a delay appropriate to the position of the selected articles at the time of selection. However it is to be appreciated that a wide variety of forms of conveying means and control means may be adopted within the scope of the invention. For example the conveying means may comprise a plain conveyor belt or may comprise means for presenting discontinuously a series of batches of articles to be sorted into the inspection area, and the articles may remain stationary in the inspection area for an interval of time. In some cases the image means may include a video camera (or other visual input device) arranged to traverse the inspection area with a field of view of the camera, for example while a batch of articles is stationary in the inspection area. In these or other forms of the invention the selection means may include means for identifying a selected article by tagging or labelling the article after selection, for example by applying a dye or other colouring or identifying material to the article selected. These variations, and the embodiments described hereinbefore, may be combined in various combinations all falling within the scope of the invention.

It is to be appreciated that the invention is not limited to arrangements in which selection of an object by a selection means necessarily results in that particular object being physically deflected. Although such an arrangement may conveniently be used, the inverse arrangement may be equally suitable, that is to say that a main throughput of articles may be deflected (for example by falling on to inclined fingers in a finger bank) and those articles specifically selected by a selection means may be allowed to fall through the finger bank undeflected, by the step of withdrawing appropriate fingers from their deflecting positions in the finger bank. As has been mentioned, the deflector means of the present invention may take many different forms and in its broadest sense the term deflector means includes any means for effecting a sorting operation by selectively moving or removing selected or unselected or differently selected articles.

As has been mentioned, it can be arranged for two probes to be available for operation by a single operator using, for example, one probe in each hand. Such an arrangement may be provided merely to allow convenience and speed of operation, but in some arrangements the two probes can be arranged to identify selected objects differently and to produce different effects upon objects when the objects reach the deflector means. For example where a three-choice deflection is available as in the embodiment of FIG. 6, one hand-held probe may be arranged to select objects to be deflected to the left and one to select objects to be deflected to the right. In the absence of selection by either probe, the objects may be left free to fall to the centre conveyor belt. This allows for example sorting of objects into three grades such as "perfects", "seconds" and "rejects".

Other features of the invention which should be appreciated include the capability, in some forms, to convey articles on a relatively wide conveyor belt, for example 6 ft wide, and to divide the image presented at the monitor into a number of sections of the conveyor, each section being the responsibility of an individual operator using an individual probe selection means. This can be arranged to have the effect of a number of operators selecting articles from a conveyor belt much wider than would be practical if each operator needed to lean physically across the belt to select a particular article.

We claim:

1. Article sorting apparatus comprising:

conveying means for conveying articles to be sorted through an inspection area;

image means comprising a television camera and a television monitor screen for displaying at the monitor screen an image of the inspection area simultaneously showing two or more articles to be sorted;

selection means for selecting an article from the two or more articles displayed at the monitor screen and for generating signals indicative of the selected article, including a hand-held light pen movable relative to the screen for indicating a location on the screen corresponding to a location of a selected article in the inspection area and for generating a location signal indicative of the location on the screen indicated by the light pen, and switch means positioned on the light pen and operable by touch of pressure of the light pen on the screen to generate at a chosen time a signal indicative of the transient position of the selected article in the inspection area;

deflector means for selectively deflecting articles conveyed by the conveying means; and control means for actuating the deflector means in dependence upon signals generated by the selection means to effect selective deflection of articles in response to article selection by an operator observing the monitor screen.

2. Apparatus according to claim 1 in which the deflector means are situated downstream of the inspection area relative to the movement of the conveyor means, and there are provided conveyor sensor means for producing and feeding to the control means signals dependent upon the speed of the conveyor means, the control means being arranged to control actuation of the deflector means at times related to the transient positions of selected articles in the inspection area at the time of selection and to the speed of movement of said articles from the inspection area to the deflector means.

3. Apparatus according to claim 1 in which there is provided a plurality of selection means for operation by one or more operators, each selection means allowing selection of articles being conveyed through the inspection area.

4. Apparatus according to claim 1 in which there is provided a plurality of monitor display areas showing the same image of the same inspection area and a plurality of selection means for operation by different operators, each selection means allowing selection of articles being conveyed through the common inspection area.

5. Apparatus according to claim 1 in which the control means is arranged to actuate the deflector means in dependence upon first and second co-ordinate signals representative of first and second orthogonal co-ordinates of locations at the monitor display area, the orthogonal co-ordinates being arranged with the first co-ordinate in a direction corresponding to a direction across the path of travel of the conveyor means at the inspection area and with the second co-ordinate in a direction corresponding to a direction aligned along the path of travel of the conveyor means at the inspection area.

6. Apparatus according to claim 5 in which the deflector means comprises an array of deflector devices arranged across the path of the conveyor means downstream of the inspection area, and drive means for driving the selected deflector devices, the selection of deflector devices actuated being controlled in dependence upon the said first co-ordinate signals and the timing of operation of the deflector devices being controlled in dependence upon the said second co-ordinate signals.

7. A method of sorting articles comprising the steps of:

conveying articles to be sorted through an inspection area;

displaying at a television monitor screen an image of the inspection area showing simultaneously two or more articles to be sorted;

selecting an article from the two or more articles displayed at the monitor screen and generating signals indicative of the selected article, by moving relative to the screen a hand-held light pen for indicating a location on the screen corresponding to a location of a selected article in the inspection area and by generating a location signal indicative of the location on the screen corresponding to a location of a selected article in the inspection area and by generating a location signal indicative of the location on the screen indicated by the light pen, and by operting switch means positioned on the light pen by touch or pressure of the light pen on the screen to generate at a chosen time a signal indicative of the transient position of the selected article in the inspection area, and selectively deflecting articles in dependence upon article indicating signals generated by the said selection steps.

8. A method according to claim 7 including the step of generating conveyor sensing signals dependent upon the speed of conveying of the articles, the step of selectively deflecting articles comprising arranging the deflector means downstream of the inspection area, and the step of actuating the deflector means comprising actuating the deflector means at times related to the transient positions of selected articles at the times of selection thereof and related to the speed of movement of said articles from the inspection area to the deflector means.

9. A method according to claim 7 in which the signals indicative of selected articles are generated by generating first and second co-ordinate signals representative of first and second orthogonal co-ordinates of a location on the monitor display area, the orthogonal co-ordinates being arranged with the first co-ordinate in a direction corresponding to a direction across the path of conveying of the articles at the inspection area and with the second co-ordinate in a direction corresponding to a direction aligned along the path of conveying of the articles at the inspection area.

10. A method according to claim 9 in which the step of selectively deflecting articles comprises arranging an array of deflector devices across the path of conveying of the articles downstream of the inspection area, and actuating selected deflector devices, the selection of deflector devices actuated being controlled in dependence upon the said first co-ordinate signals and the timing of operation of the deflector devices being controlled in dependence upon the said second co-ordinate signals.

11. Article sorting apparatus comprising:

conveying means for conveying articles to be sorted through an inspection area;

image means comprising a television camera and a television monitor screen for displaying at the monitor screen an image of the inspection area simultaneously showing two or more articles to be sorted;

selection means for selecting an article from the two or more articles displayed at the monitor screen and for generating signals indicative of the selected article, including a hand-held light pen movable relative to the screen for indicating a location on the screen corresponding to a location of a selected article in the inspection area and for generating a location signal indicative of the location on the screen indicated by the light pen, and switch means positioned on the light pen and comprising an acoustic transducer for detecting acoustically a touch of the light pen on the screen and operable for generating at a given time a signal indicative of the transient position of the selected article in the inspection area;

deflector means for selectively deflecting articles conveyed by the conveying means; and control means for actuating the deflector means in dependence upon signals generated by the selection means to effect selective deflection of articles in response to article selection by an operator observing the monitor screen.

12. Article sorting apparatus comprising:

conveying means for conveying articles to be sorted through an inspection area;

image means comprising a television camera and a television monitor screen for displaying at the monitor screen an image of the inspection area simultaneously showing two or more articles to be sorted;

selection means for selecting an article from the two or more articles displayed at the monitor screen and for generating signals indicative of the selected article, including a hand-held light pen movable relative to the screen for indicating a location on the screen corresponding to a location of a selected article in the inspection area and for generating a location signal indicative of the location on the screen indicated by the light pen, and switch means positioned on the light pen and operable by touch or pressure of the light pen on the screen to generate at a chosen time a signal indicative of the transient position of the selected article in the inspection area;

conveyor sensor means for producing signals dependent upon the speed of the conveying means;

deflector means for selectively deflecting articles conveyed by the conveying means and comprising an array of deflector devices arranged across the path of the conveying means downstream of the inspection area and drive means for driving selected deflector devices; and control means for actuating the deflector means in dependence upon signals generated by the selection means to effect selective deflection of articles in response to article selection by an operator observing the monitor screen, said control means being arranged to actuate the deflector means in dependence upon first and second coordinate signals representative of first and second orthogonal coordinates of locations at the television monitor screen, the orthogonal coordinates being arranged with the first coordinate in a direction corresponding to a direction across the path of travel of the conveying means at the inspection area and with the second coordinate in a direction corresponding to a direction aligned along the path of travel of the conveying means at the inspection area, the selection of which of said deflector devices is or are actuated being controlled in dependence upon the said first coordinate signals and the timing of operation of the deflector devices being controlled in dependence upon the said second coordinate signals and in dependence upon the speed of movement of said articles from the inspection area to the deflector means as detected by said conveyor sensor means.

13. A method of sorting articles comprising the steps of:

conveying articles to be sorted through an inspection area;

displaying at a television monitor screen an image of the inspection area showing simultaneously two or more articles to be sorted;

selecting an article from the two or more articles displayed at the monitor screen and generating signals indicative of the selected article, by moving relative to the screen a hand-held light pen for indicating a location on the screen corresponding to a location of a selected article in the inspection area and by generating a location signal indicative of the location on the screen indicated by the light pen, and by operating switch means comprising an acoustic transducer positioned on the light pen by detecting acoustically a touch of the light pen on the screen to generate at a chosen time a signal indicative of the transient position of the selected article in the inspection area, and selectively deflecting articles in dependence upon article indicating signals generated by the said selection steps.

* * * * *